US005292136A

United States Patent [19]

Cline

[11] Patent Number: 5,292,136

[45] Date of Patent: Mar. 8, 1994

[54] GAME OF SKILL

[76] Inventor: Michael A. Cline, 3265 S. Cincinnati, Tulsa, Okla. 74105

[21] Appl. No.: 919,849

[22] Filed: Jul. 27, 1992

[51] Int. Cl.[5] ..... A63B 67/10

[52] U.S. Cl. ..... 273/440; 273/329; 273/412; 273/414

[58] Field of Search ..... 273/440, 319, 327, 329, 273/330, 331, 332, 412, 413, 414

[56] References Cited

U.S. PATENT DOCUMENTS

| | | | |
|---|---|---|---|
| 667,373 | 2/1901 | Thorngren | 273/327 X |
| 884,387 | 4/1908 | Hettinger | 273/319 X |
| 2,307,905 | 1/1943 | Ament | 119/29 |
| 2,485,788 | 10/1949 | Terrell | 273/319 |
| 4,783,092 | 11/1988 | Kandal | 273/319 |

FOREIGN PATENT DOCUMENTS

| | | | |
|---|---|---|---|
| 453530 | 12/1949 | Italy | 273/319 |

*Primary Examiner*—William H. Grieb

[57] ABSTRACT

A game of skill comprising a three piece game set including two sticks or rods and a ball, with the ball attached to one of said sticks with a string. After placing the ball on the end of one stick, the object of the game is to transfer the ball to the end of the other stick without touching the ball or using the string. This is done by placing a rapid movement downward of the stick holding the ball while holding the second stick near the hole and catching it as the first stick is lowered. The process can be repeated transfering the ball back to the first stick and so on.

6 Claims, 2 Drawing Sheets

GAME OF SKILL

TECHNICAL FIELD

This invention relates to a game of skill and, more particularly, to a test of skill involving transfering an object from the end of one rod or stick to another. While pure amusement is important, it will also find utility in developing motor skills, concentration, and focus. Further, it will provide theraputic value for people who have lost some capabilities in that they can relearn the skills mentioned.

BACKGROUND

My invention was developed from an experiment I witnessed. In that experiment, a friend placed a ball with a hole on it on the small end of a drumstick and not otherwise attached thereto. The hole extended straight into the ball and the ball had a flattened area around the hole. A second stick was placed near the hole, both sticks being in a generally vertical position. Attempts were then made to transfer the ball from the first stick to the second by a slow upward movement of the second stick and attempting to pierce the hole. Frequently, attempts were not successful and the ball had to be retrieved after it fell to the floor or other surface.

Another game of skill uses a stick or handle having a cup on the end. Attached to the stick is a string with a ball at the end. The object of the game is to swing the ball up above the cup and to catch the ball in the cup. This differs from my invention in which the ball stays relatively stationary while the sticks are moved.

U.S. Pat. No. 2,307,905 (1943) discloses a wooden rod with a ball on a string attached to one end of the rod suitable for use in exercising pets. While different balls can be used, the concept is different from that disclosed herein.

SUMMARY OF THE INVENTION

Broadly, my invention resides in a game of skill comprising a first rod having a tapered end, an object of greater cross section than said tapered end, a second rod having a tapered end similar in configuration to end of said first rod, and a cord attached to said first rod and said object. Preferably the object is made in the shape of a ball. The area around the hole in the object can be varied.

The game is played by placing the ball on one stick and transfering it to the other by holding the sticks in both hands and moving one relative to the other. Variation in the surface around the hole requires varying degrees of skill.

DETAILED DESCRIPTION

Figure 1A:
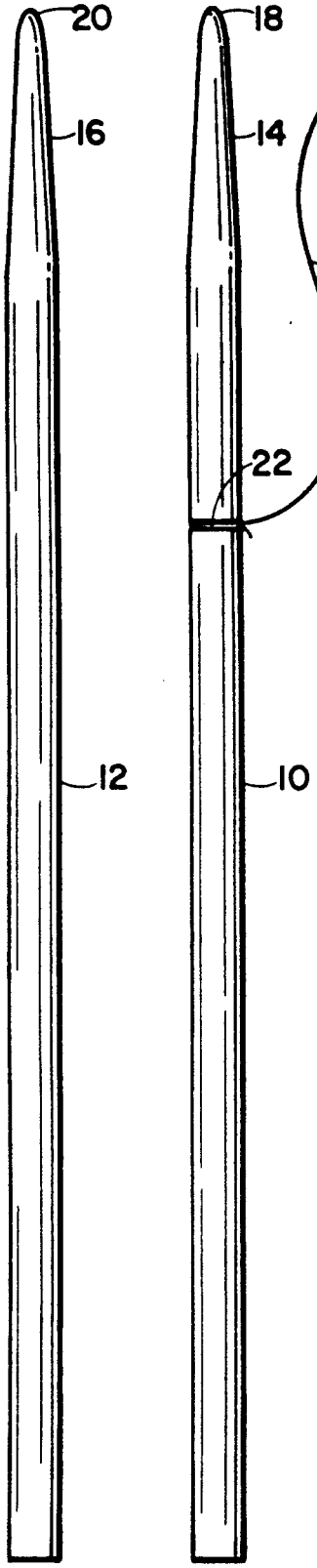
FIGS. 1*a* and 1*b* illustrate the basic elements of the invention.
Figure 1B:
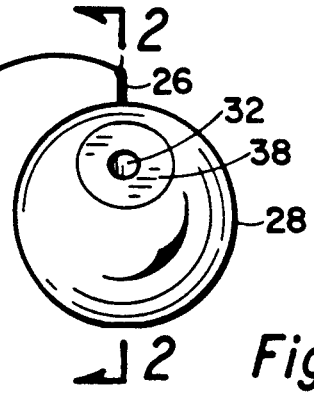
Figure 2:
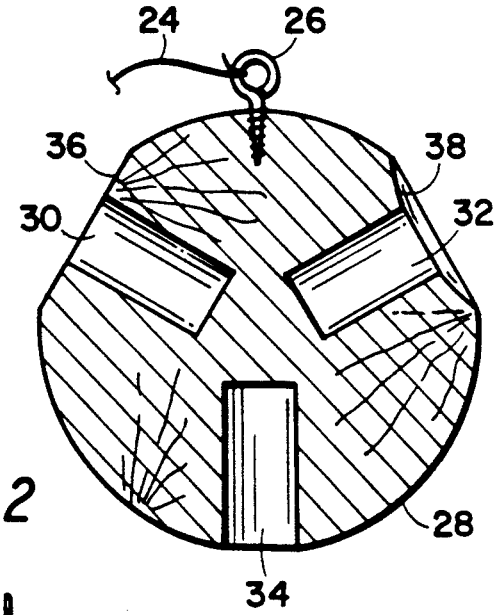
FIG. 2 is a cross section view on line A—A of FIG. 1*b*.

Referring now to the drawing, the invention will be described in detail. Dimensions are given of a preferred embodiment but considerable variation can be made as long as the components are easily handled. Shown in FIGS. 1*a* and 1*b* are first and second sticks 10 and 12 which are substantially identical in overall shape. They are half-inch diameter, fifteen inch long dowels, tapered and rounded at one end 14 and 16. Taper begins two and one-half inches from end. Roundings 18 and 20 starts three-eighths of an inch from the end. The first stick 10 has a groove 22 thereon, for attachment of a string 24 thereto. String is attached below tapered area. Other methods of attaching the string 24 to stick 10 can be used. The other end of string 24 is attached by suitable means, here an eye 26 to a ball 28 (FIG. 1*b*). A representative ball 28 can be two inches in diameter and is shown in section A—A in FIG. 2.

Ball 28 contains a plurality of holes having different surfaces around the outer ends thereof for varying the difficulty of the game. Holes can be three-eighths inch diameter. Shown are holes 30 having a flattened or shaved off area 36 surrounding the opening, hole 34 where a spherical surface extends to the outlet of the hole, and hole 32 wherein the opening is surrounded by a concave surface 38 extending into the ball 28. These surfaces surrounding the hole provide for different degrees of or levels of difficulty in playing the game with hole 34 having most difficulty, hole 30 of intermediate difficulty, and hole 32 being easiest. Surfaces 36 and 38 are approximately seven-eighths inch in diameter.

Figure 3:
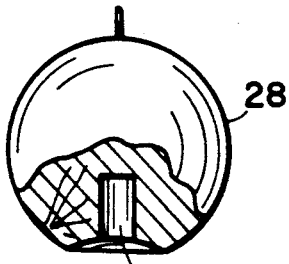
FIGS. 3, 4, and 5 illustrate, partly in section, various modifications of the ball.
Figure 4:
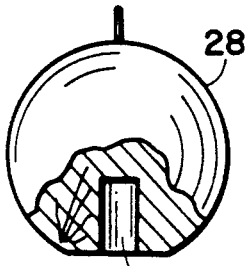
Figure 5:
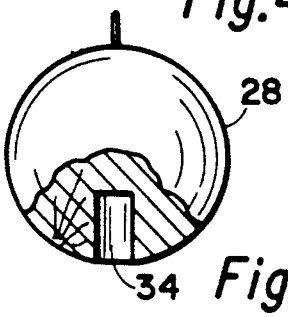

As shown in FIGS. 3, 4, and 5, three separate balls can be used in place of the one shown in FIG. 1. Reference numerals are those of FIG. 2.

The string 24 is important to the acceptance of this game. It keeps the ball in play and eliminates the problem of retrieving the ball after an unsuccessful attempt. Without the string the ball falls where things can be broken or roll to places where it is hard to get to.

A wide variety of materials can be used for the components of the invention. Wood has been used. Metal and plastics are also suitable. Examples include polyolefins, polystyrene, acrylics, polyesters, etc.

Figure 6:
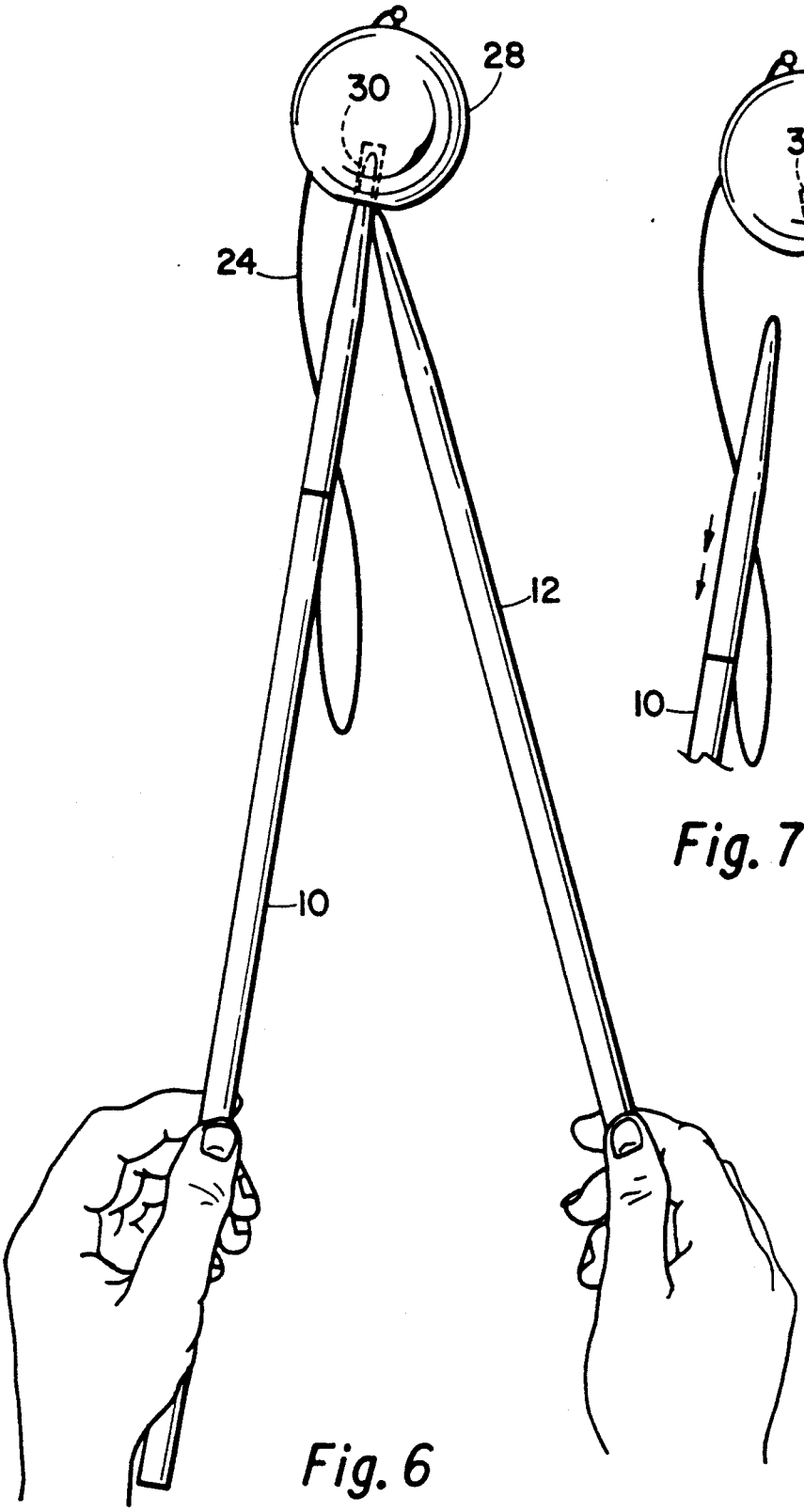
FIGS. 6 and 7 illustrate the position of the elements of the invention before and after successful transfer of the object from one stick to the other.
Figure 7:
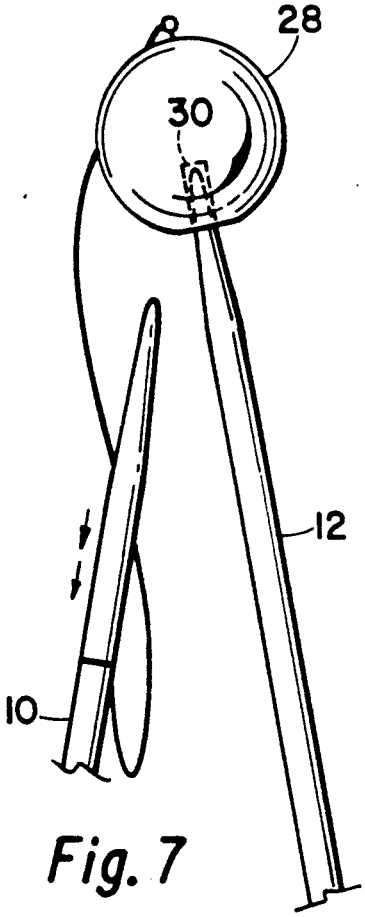

FIGS. 6 and 7 illustrate operation of the game which is generally to transfer the ball from the end of one stick to the other. In FIG. 6 the ball is placed on stick 10 with stick 12 held as shown. With a rapid motion (FIG. 7) stick 10 is moved downward withdrawing stick 10 from the hole and stick 12 is inserted. This process is repeated returning the ball 28 to stick 10. The game is good for sole play but also can be played by two or more players. In the latter case, the game may go to a predetermined number (5, 10, 15, etc.) or by players trying for the most transfers in a row.

It should be understood that various changes and modifications can be made without departing from the spirit and scope of the invention.

What is claimed is:

1. Apparatus for playing a game of skill wherein a relatively stationary object is transferred from one rod to another comprising:

(a) a first rod having a tapered end, (b) a ball of cross section greater than said tapered end having three openings therein, one extending directly into the spherical surface of the ball, one having a flattened surface around the opening, and one having a concave surface around the opening, each opening adapted to fit loosely over said tapered end, (c) a cord attached to said first rod and said ball, and (d) a second rod having a tapered end similar in configuration to the end of said first rod.

2. The apparatus of claim 1 wherein said first and second rods are circular in cross section.

3. Apparatus for playing a game of skill wherein a relatively stationary object is transferred form one rod to a second rod comprising:

(a) a first rod having a tapered end, (b) an object of cross section greater than said tapered end, said object containing a plurality of holes adapted to fit loosely over said tapered end, said holes being surrounded by areas of different configuration to provide different levels of difficulty, (c) a cord attached to said first rod and said object, and (d) a second rod having a tapered end similar to the end of said first rod.

4. Apparatus for playing a game of skill wherein a relatively stationary object is transferred from one rod to a second rod comprising:

(a) a first rod having a tapered end, (b) a plurality of objects of cross section greater than said tapered end, each of said objects containing a hole adapted to fit loosely over said tapered end, and wherein the area around the hole in each of the objects is different from the area around the holes in each of the other objects, to provide different levels of difficulty, (c) a core attached to said first rod and an object, and (d) a second rod having a tapered end similar to the end of said first rod.

5. The apparatus of claim 4 wherein said plurality of objects consists of three balls.

6. The apparatus of claim 5 wherein one ball has an opening extending into the spherical surface of the ball, a second ball has a flattened surface around the hole, and the third ball has a concave surface around the hole.

* * * * *